United States Patent [19]

Vaught

[11] Patent Number: 5,035,583

[45] Date of Patent: Jul. 30, 1991

[54] SEWAGE PUMP PRIMING SYSTEM

[75] Inventor: Reid W. Vaught, Kansas City, Mo.

[73] Assignee: Smith & Loveless, Inc., Lenexa, Kans.

[21] Appl. No.: 496,884

[22] Filed: Mar. 21, 1990

[51] Int. Cl.[5] ..... F04D 9/04

[52] U.S. Cl. ..... 417/200; 137/392

[58] Field of Search ..... 417/199.2, 200; 137/392

[56] References Cited

U.S. PATENT DOCUMENTS

| | | | |
|---|---|---|---|
| 3,519,369 | 9/1970 | Weis | 417/200 X |
| 3,558,012 | 1/1971 | Weis | 417/360 X |
| 3,630,637 | 12/1971 | Repp | 417/200 X |
| 4,390,793 | 6/1983 | John | 137/392 X |
| 4,515,517 | 5/1985 | Sloan | 417/200 X |
| 4,525,792 | 6/1985 | Clinton | 364/509 |
| 4,613,802 | 9/1986 | Kraus | 318/483 |
| 4,739,786 | 4/1988 | Parkinson | 137/392 X |
| 4,800,755 | 1/1989 | Fathaver et al. | 73/304 C |
| 4,809,129 | 2/1989 | Hansen et al. | 137/392 X |

OTHER PUBLICATIONS

Bulletin entitled "Proxistor" by Huntleigh Technology plc.

Bulletin entitled "Posi Switch Proximity Switches" by Electrical & Electronic Controls, Inc., Bulletin No. 103.

Publication entitled "P&F Proximity Sensors".

Publication entitled "Threaded Barrel Capacitive Proximity Limit Switches" by General Electric Co., 1986.

*Primary Examiner*—John Rivell

*Attorney, Agent, or Firm*—Dressler, Goldsmith, Shore, Sutker & Milnamow, Ltd.

[57] ABSTRACT

A vacuum priming system for drawing liquid into the pumping chamber to prime a vertical shaft centrifugal pump for pumping sewage or the like. The vacuum priming system includes a priming pump for developing a partial vacuum in the pumping chamber and causing liquid to be drawn into the pumping chamber to evacuate air therefrom. A sensor is provided for detecting the interface between the liquid and air in an area in or above the pumping chamber for activating and deactivating the priming pump. The sensor comprises a low sensitivity capacitive proximity sensor having a generally vertical sensing face for sensing the relative movement of the interface between the liquid and air.

3 Claims, 1 Drawing Sheet

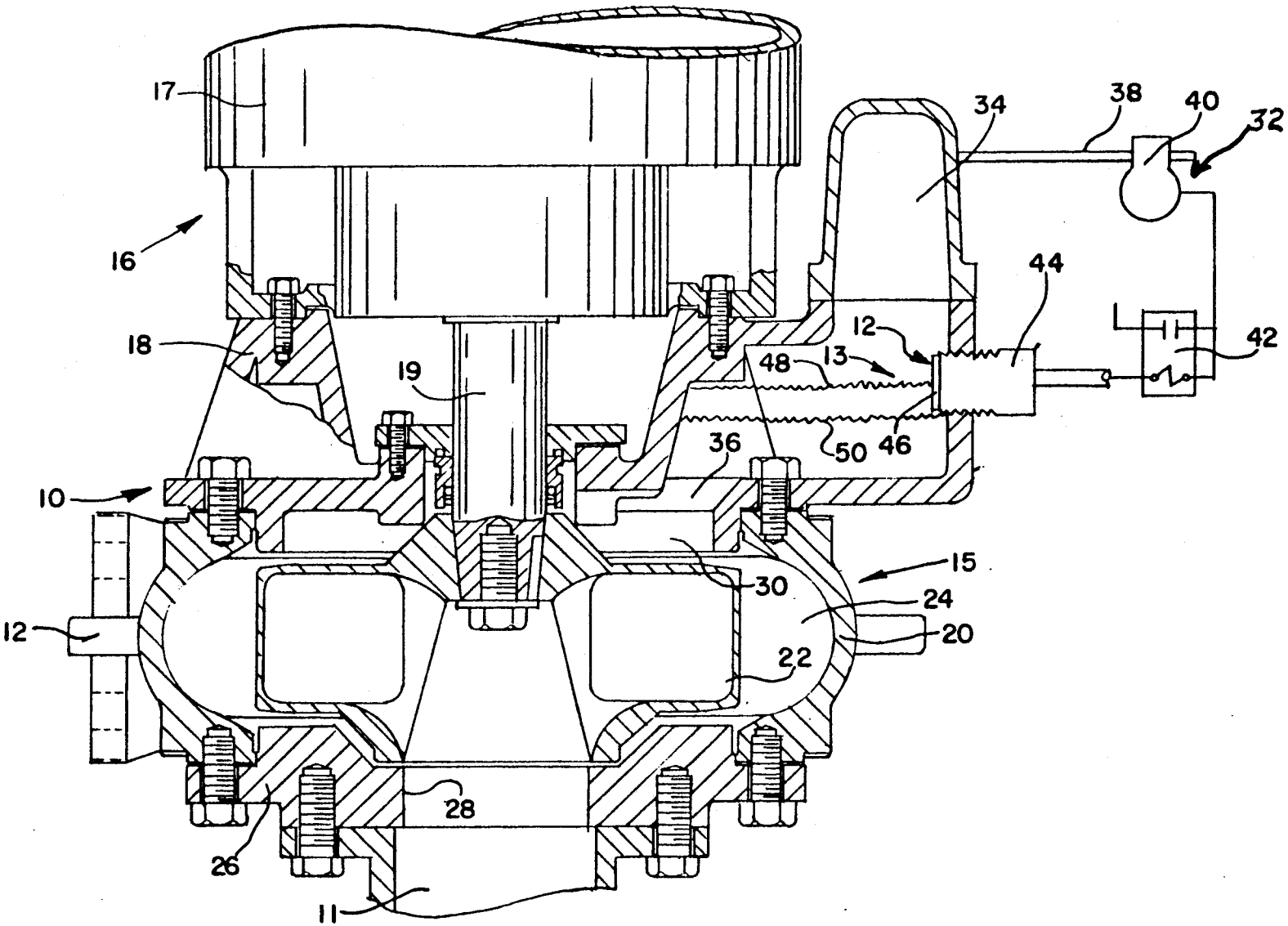
32
40
38
34
42
44
12
13
46
50
48
36
15
24
20
30
22
19
28
11
26
17
16
18
10
12

SEWAGE PUMP PRIMING SYSTEM

BACKGROUND OF THE INVENTION

This invention relates generally to sewage pumps, and more specifically to an improved priming system for a vertical shaft centrifugal pump of the type used in sewage pump stations.

Sewage pump stations typically include one or more vertical shaft centrifugal pumps that are usually mounted above the sewage level in the sewage receiving wet well. Since such pumps are not able to induce a vacuum by expulsing air from the pumping chamber, to draw liquid thereinto to fill the chamber, and thereby permit the pump to perform its liquid pumping function, it is necessary that the pumping chamber be primed or filled with a liquid by separate means. Such means typically includes a vacuum priming system for withdrawing air from a vacuum chamber in fluid communication with the pumping chamber. Examples of sewage pumps having such a priming system are disclosed in U.S. Pat. Nos. 3,519,369 and 3,558,012, which patents are commonly assigned to the same assignee as this invention.

The vacuum priming system must have a sensing means to determine when sufficient air is withdrawn from the priming chamber to control the operation of the vacuum priming pump. It has been the heretofore practice to utilize either an electrically conductive type sensor or a mechanical displacement type sensor. The conductive type sensor includes a metal rod or electrode to complete an electrical circuit through a relay when the liquid rises around the electrode. The circuit is from a power source through the metal frame, liquid, electrode, relay and back to the power source. Obviously, if anywhere in this circuit it becomes open or non-conductive, the circuit will not function. It has been found that as the electrode becomes coated with grease and solids from the sewage, it becomes non-conductive. Therefore, it has been necessary to clean the electrode every few weeks to avoid malfunction of the priming system. Malfunction can also be caused by bridging of solids or liquids to the frame. The electrode also inherently requires a non-conductive holder, made of a material such as plastic, which reduces the pressure rating of the pump.

The mechanical displacement type sensor typically utilizes either a float to move a set of electrical contacts between a closed or open position or a float containing a magnet that moves up and down a stationary rod containing reed switches that open or close in response to the position of the float. Both of these systems require a moving part in the sewage area that over a period of time tends to seize up. Accordingly, the mechanical displacement type sensors also require frequent cleaning and maintenance.

There is a need for a sensor means for use in the priming system of a sewage pump requiring no cleaning or other maintenance and yet is reliable in operation. There is further a need for such a sensor means that permits a high pump pressure rating. There is still a further need for such a sensor means that does not present a voltage in the sewage area or on top of the pump as is found in certain conductive type sensors.

SUMMARY OF THE INVENTION

The present invention is embodied in an improved vacuum priming system for a vertical shaft centrifugal pump particularly adapted for use in connection with pumping sewage, waste streams, or the like. The priming system utilizes a sensor means that does not require frequent cleaning, is reliable in operation, and does not have voltage in the sewage area or at the top of the pump.

In accordance with the invention, the sensor means comprises a low sensitivity capacitive proximity sensor. The sensor has a sensing face that extends into the priming chamber in a substantially vertical orientation. The sensing face acts as one plate of a capacitor, the air in the priming chamber acts as the dielectric, and the sewage in the priming chamber acts as the other plate of the capacitor. The maintenance free operation of the sensor relies on the fact that the dielectric strength of sewage is radically higher than the dielectric strength of air, even with a coating of grease and solids on the sensing face. The sensor differs from prior art devices in that it senses only liquid when it is sensing the relative movement of the interface between air and liquid.

BRIEF DESCRIPTION OF THE DRAWING

The invention, together with its construction and method of operation, is illustrated more or less diagrammatically in the drawing, in which FIG. 1 is a vertical section of a vacuum prime pump incorporating a priming system in accordance with a preferred embodiment of the invention.

DESCRIPTION OF A PREFERRED EMBODIMENT

Referring to FIG. 1, a vertical shaft centrifugal pump assembly is illustrated generally at 10. Pump assembly 10 is adapted to be incorporated in a sewage pump station. As such, it is designed to draw solid-bearing liquid sewage from a receiving tank (not shown) into an inlet port or pipe 11 and pump the sewage from a discharge nozzle 12 to suitable sewage treatment means.

The pump assembly is generally vertically elongated and includes a lower pump section 15 and an upper drive motor section 16. The drive motor section 16 includes an oversized, heavy-duty electric motor 17. The motor 17 is mounted on the pump section 15, and a vertically disposed motor shaft 19 extends downwardly from the motor casing through an adapter 18 into the pump section 15.

The shaft 19 extends into an annular pump volute 20. The pump volute contains a conventional impeller 22 which draws solid-bearing liquid sewage upwardly from inlet port 11 and discharges it through a generally horizontally disposed discharge nozzle 12. The volute housing 20 has an annular configuration in plan view and forms the side wall of a pumping chamber 24. A plate 26, having a centrally disposed aperture 28, in communication with inlet pipe 11, forms the bottom wall of pumping chamber 24. The impeller 22 is mounted on the lower end of shaft 19 for rotation with the shaft in a well-known manner.

As will be recognized, rated pump pressure is effective in the chamber 24 around the impeller 22 and in the discharge nozzle 12. At the same time, an annular dish shaped chamber 30 above the impeller 22 is subjected to a relatively low pressure. The pump is provided with a vacuum type priming system 32 to draw sewage into the pumping chamber 24 before the pump 10 is started to initiate normal operation of the pump.

The priming system 32 includes a priming chamber 34 which communicates with the chamber 30 above the impeller 22 through a port connection 36. Connected to the chamber 34 is a vacuum line 38. The vacuum line 38 is connected to a vacuum priming pump 40. The priming pump 40 is driven by an electric motor (not shown) through a conventional control circuit and panel 42 well known in the art. Operation of the pump 40 is controlled through the control circuit 42 wherein a switching device is provided to activate and deactivate the priming pump motor.

In accordance with the present invention, the switching device in control circuit 42 is controlled by a low sensitivity capacitive proximity sensor 44 that extends into priming chamber 34. Sensor 44 is preferably of the type that acts similarly to a simple capacitor. The end of the sensor 44 typically has a metal sensing face 46 that is electrically connected to an oscillator housed in the sensor. When power is applied to the sensor, the oscillator senses the external capacitance between a target (actuating medium) and the sensing face 46. As the activating medium approaches the sensing face, the capacitance increases, and when it is sufficient, the oscillator begins oscillation. When the actuating medium is removed oscillation ceases again. The commencement and ceasing of oscillation, evaluated by a connected electronic circuitry, produces a change in the switching state of the sensor. A built-in potentiometer permits fine adjustment of the actuating distance. Examples of such sensors are General Electric Model Nos. CR215DBA and CR215CB.

Referring to FIG. 1, the sensor 44 is screwed into an opening in the housing defining the priming chamber 34 such that the sensing face 46 is located inside the chamber in a substantially vertical orientation. The sensing face 46 is preferably at least 30 degrees from a horizontal orientation to prevent water droplets from accumulating on the sensing face. As the liquid level rising in chamber 34 during priming reaches the level indicated by reference numeral 48, the capacitance in the sensor is sufficiently high to activate the switching state of the sensor, which turns off the priming motor 40. As the liquid level in chamber 34 drops to the level indicated by reference numeral 50, the large drop in the capacitance de-activates the switching state of the sensor, which turns on the priming motor 40 until the liquid level rises to the level 48.

In so doing, the sensor 44 senses the differences of liquid coverage of the sensing face 46. The high liquid dielectric strength of sewage is used to an advantage. Since the sensing face 46 is vertically oriented, as the liquid level in chamber 34 rises, it covers part of the face 46 and the capacitance quickly rises. As the liquid level in chamber 34 falls, it covers a smaller portion of face 46 and the capacitance change is substantial. In view thereof, the sensitivity requirement of the sensor 44 is quite low. Since the capacitance of a thin film of liquid or solids covering the face 46 is small compared to the capacitance difference of a small movement of the liquid in chamber 34, such film does not adversely effect the operation of the sensor 44.

The use of sensor 44 of the present invention differs from heretofore sensors used to control a pump priming system in that the sensor 44 senses the movement of the interface between the air and liquid in the priming chamber.

While the embodiment described herein is at present considered to be preferred, it is understood that various modifications and improvements may be made therein, and it is intended to cover in the appended claims all such modifications and improvements as fall within the true spirit and scope of the invention.

What is claimed is:

1. In a vertical shaft centrifugal pump for pumping sewage including a housing defining a pumping chamber having an impeller rotatably mounted therein, said pumping chamber having a generally annular side wall with a discharge nozzle in one quadrant of its circumference and a bottom wall defining an inlet port, the improvement in a vacuum priming system for drawing liquid into said pumping chamber to prime the pump, comprising:

(a) priming pump means for developing a partial vacuum in said pumping chamber and causing liquid to be drawn into said pumping chamber to evacuate air therefrom;

(b) sensing means for detecting the interface between the liquid and air in an area in or above said pumping chamber for activating and deactivating said priming pump means; and (c) said sensing means comprising a low sensitivity capacitive proximity sensor means having a sensing face for sensing the relative movement of said interface between the liquid and air, said sensing face being at least 30 degrees from a horizontal orientation.

2. The invention as defined in claim 1 wherein said sensing face is positioned in a substantially vertical orientation.

3. The invention as defined in claim 2 wherein said sewage pump includes a priming chamber positioned above said pumping chamber in fluid communication therewith and said sensing means extends into said priming chamber to sense the interface between the liquid and air therein.

* * * * *